US009352606B2

(12) United States Patent
Merzon

(10) Patent No.: US 9,352,606 B2
(45) Date of Patent: May 31, 2016

(54) BINDER WITH A LATTERALLY EXTENDABLE SPINE

(76) Inventor: Adam Merzon, Greenwich, CT (US)

( * ) Notice: Subject to any disclaimer, the term of this patent is extended or adjusted under 35 U.S.C. 154(b) by 318 days.

(21) Appl. No.: 13/195,048

(22) Filed: Aug. 1, 2011

(65) Prior Publication Data

US 2012/0087713 A1 Apr. 12, 2012

Related U.S. Application Data

(63) Continuation-in-part of application No. 12/763,193, filed on Apr. 19, 2010, now abandoned.

(51) Int. Cl.

| | |
|---|---|
| ***B42F 13/38*** | (2006.01) |
| ***A45C 3/02*** | (2006.01) |
| ***A45C 13/02*** | (2006.01) |
| ***B42F 5/00*** | (2006.01) |
| ***B42F 13/00*** | (2006.01) |
| ***B42F 13/36*** | (2006.01) |
| *A45C 13/10* | (2006.01) |

(52) U.S. Cl.

CPC . *B42F 13/38* (2013.01); *A45C 3/02* (2013.01); *A45C 13/02* (2013.01); *B42F 5/00* (2013.01); *B42F 13/0033* (2013.01); *B42F 13/36* (2013.01); *A45C 13/103* (2013.01); *B42P 2241/04* (2013.01); *B42P 2241/06* (2013.01); *B42P 2241/18* (2013.01)

(58) Field of Classification Search

CPC ..... B42F 13/38; B42D 1/06
USPC ..... 402/73–78; 281/48–51
See application file for complete search history.

(56) References Cited

U.S. PATENT DOCUMENTS

| | | | | | |
|---|---|---|---|---|---|
| 2,856,728 | A * | 10/1958 | Guinane | 248/447 |
| 3,322,129 | A * | 5/1967 | Drysdale | 281/17 |
| 5,921,693 | A * | 7/1999 | Martiniak | 402/9 |
| 6,142,529 | A * | 11/2000 | Liao | 281/29 |
| 2007/0086845 | A1 * | 4/2007 | Merzon | 402/73 |

* cited by examiner

*Primary Examiner* — Matthew G Katcoff
(74) *Attorney, Agent, or Firm* — Law Office of Stephen Cannavale LLC

(57) ABSTRACT

A binder arrangement comprising, a pair of binder covers pivotable about an axis into an opposed orientation, a single set of binder rings attached to said binder covers, a pair of hinges for pivoting said pair of covers into an opposed orientation; and a spine for separating said pair of binder covers, wherein said binder covers have a slot for slidably attaching said binder covers to said spine.

4 Claims, 6 Drawing Sheets

BINDER WITH A LATTERALLY EXTENDABLE SPINE

CROSS REFERENCE TO RELATED APPLICATION

This application is a continuation in part of U.S. patent application Ser. No. 12/763,193, filed on Apr. 19, 2010 now abandoned, the entirety of which is incorporated by reference herein.

FIELD OF THE INVENTION

The present invention relates to binders, and more specifically to a binder spine that may be laterally extended to lengthen the distance between the binder front cover and back cover and thereby increase the storage volume of the binder. The binder of the present invention includes front and back binder covers that are laterally movable with respect to each other.

BACKGROUND OF THE INVENTION

In the past, binder arrangements consisted of a pair of covers each joined to a spine by a hinge with at least one set of binder rings, such as a three ring binder, attached to an inside surface of one of the covers. In previous binder arrangements, the hinge was a conventional hinge that is a separate component that attaches to the spine and one of the covers. Unfortunately, use of a separate hinge is not only more costly to produce, but it also increases assembly costs because it requires more assembly steps. More recently, living hinges formed by a break or weakness in a board of one-piece construction have been used to break the board up into a pair of covers and a spine. However, such a hinge only permits the cover to bend relative to the spine along a single line. Where the storage volume of the binder is at or greater than the storage capacity of the binder, closing the binder becomes more difficult. In fact, repeated closings of an overfilled binder can create a crease elsewhere in one or both binder covers. Over time, such a crease can develop into a crack that leads to premature failure of the binder cover, ultimately requiring replacement of the binder. Moreover, in previous binder arrangements the capacity of the binder is fixed by the lateral dimension of the spine. In such arrangements the spine width establishes a fixed distance between the binder covers which can not be varied to accommodate increased capacity.

Finally, binder arrangements that have a pair of opposed binders often are difficult to close because the rings of one of the binders often interferes against the rings of the other one of the binders. Repeated interference can cause binder rings to bend making it difficult to open and close them. Just as bad, interference between the rings can cause creasing of one or both covers if excessive force is applied, such as what can happen out of frustration, when closing the binder arrangement.

What is needed is an improved binder arrangement that addresses the problems associated with limited and fixed capacity due to the spine dimensions and hinge arrangement.

SUMMARY OF THE INVENTION

The invention is directed to a binder arrangement that may be adjusted to accommodate varying capacities. The binder arrangement according to the present invention may be adjusted by way either, alone or in combination; lengthening the width of the spine or varying the pivot point of the hinge. By adjusting the spine width, the front and back cover of the binder may when in the closed position be separated by a longer or shorter distance, which will thereby increase or decrease the volume of the binder storage space as needed. Moreover, the binder arrangement according to the present invention may also have the interior volume adjusted by varying the pivot point of the hinges. The binder arrangement has a pair of covers connected to an adjustable spine by hinges. The inner surface of one or both covers can be equipped with a binder that has a plurality of rings capable of opening to receive sheets of material and closing to retain the sheets of material.

In one preferred embodiment, there is provided a binder arrangement comprising, a pair of binder covers pivotable about an axis into an opposed orientation, a single set of binder rings attached to said binder covers, a pair of hinges for pivoting said pair of covers into an opposed orientation; and a spine for separating said pair of binder covers, wherein said binder covers have a slot for receiving a pin that is rigidly attached to said spine for slidably attaching said binder covers to said spine.

Objects, features and advantages of the invention include one or more of the following: providing a binder arrangement equipped with hinges having a width and contour that permits bending to take place simultaneously at a plurality of locations thereby better accommodating binder ring clash and providing increased binder storage capacity; a binder arrangement that includes separate distinct binder covers, with intragrel hinges and joined by a spine. The spine is comprised of an interior an exterior plate that are each made of a board formed of economical one-piece, unitary and homogenous construction, and joined by rivets; distinct and separate front and rear binder covers that have hinges which permit bending at a plurality of pairs of locations along the hinge thereby producing a bend having a smooth radius instead of an abrupt transition. In addition each binder cover includes oval apatures adapted to receive rivets for slidabley affixing the spine plates to the front and rear binder covers. Furthermore there is provided a binder arrangement with hinges that make opening and closing easier under a wide variety of binder loading conditions; a binder arrangement having a plurality of generally opposed binders that prevents, if not eliminates, binder ring clashing by offsetting one of the binders relative to the other one of the binders.

Various other features and advantages of the present invention will also be made apparent from the following detailed description and the drawings.

BRIEF DESCRIPTION OF THE DRAWINGS

The drawings illustrate the best mode currently contemplated of practicing the present invention. One or more preferred exemplary embodiments of the invention are illustrated in the accompanying drawings in which like reference numerals represent like parts throughout and in which.

DETAILED DESCRIPTION OF AT LEAST ONE PREFERRED EMBODIMENT

Figure 1:
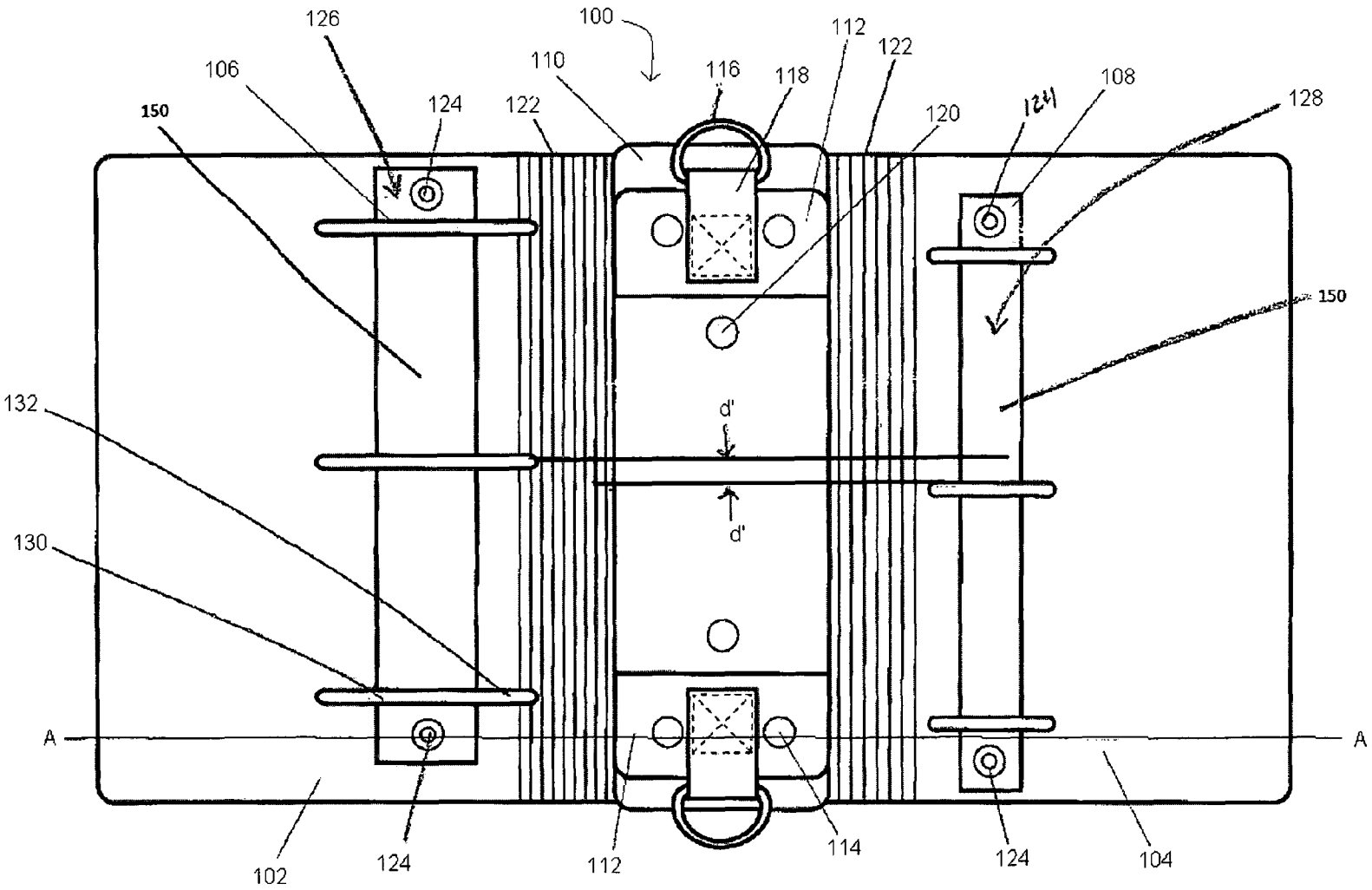
FIG. 1 is an interior plan view of a binder arrangement in an open position constructed according to the present invention.

Before explaining embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting. FIG. 1 illustrates an interior plan view of a binder arrangement in an open position constructed according to the present invention that depicts the interior surface and includes a front ring board 102 and a rear ring board 104. Each ring board preferably has attached a binder ring assembly 106 and 108. The binder ring assemblies, which will be more fully described hereinafter may preferably be of different sizes, however such a limitation is not required, moreover, in some embodiments, only a single binder ring assembly may be utilized. Additionally, there is depicted and visible in this view an interior plate 110. Interior plate 110 has mounted thereon a D-ring/zipper attachment 112, which may be, as shown here, a supplemental plate attached to the interior plate 110 using rivets 114. As shown in this view, the D-ring/zipper attachment 112 is shown in this view as having a D-ring 116 attached thereto with a strap 118. The D-ring may be made of any material that is hard and tough, such as steel, aluminum or plastic for use in connecting the binder arrangement to a flexible implement for effortless carrying. The strap 118 may be made of any suitable resilient and flexible fabric and may be permanently affixed to the D-ring/zipper attachment 112 by any means suitable and known in the art, for example by stitching, gluing, or riveting.

As will be more fully depicted and described hereinafter, rivets 114 and 120 extend through the interior plate and front ring board and rear ring board and are affixed to an exterior plate (not shown in this view).

FIG. 1 illustrates a preferred embodiment of a ring board 102 and 104 used to form a binder front cover, binder rear cover, interior plate and hinges 122 that is of homogenous construction. In a preferred embodiment, the board is constructed of a fibrous material, such as, preferably kraftboard or the like. Each cover 102 and 104 has a plurality of spaced apart binder anchors for accepting binder anchor rivets 124. Each binder anchor may preferably be a perforation or bore that extends completely through its respective cover.

As is also shown in FIG. 1, the binder arrangement has a plurality of opposed binder rings, each of which preferably is a three ring binder 126 and 128. Each binder has a mounting plate 150 that is attached to one of the covers by a plurality of spaced apart fasteners 124, each of which preferably is a rivet. Each binder 126 and 128 has a plurality of pairs of separable ring halves 130, 132 used to releasably retain pages of material. The binders 126 and 128 are spaced apart by the interior plate 110 of the spine, the width of which preferably is selected to permit the binder arrangement to be closed without the binders 126 and 128 interfering with case closure or each other. Moreover, as will be further explained hereinafter, the spine width of the binder arrangement according to the present invention is adjustable in order to provide a variable volume binder arrangement.

While a set of binder rings, each defined by a pair of reclosable ring halves 126 and 128, can be mounted to each one of the binder ring boards 102 and 104. If desired, a binder constructed in accordance with the invention can have a single set of rings mounted to or otherwise carried by either one of the front or rear ring board.

Where the binder arrangement has two or more binders, such as binder arrangement 100 that is equipped with binders 126 and 128, any pair of binders 126 and 128 that would overlie one another when the binder arrangement is closed is offset by a predetermined distance (d'-d') such that the binders 126 and 128 do not directly overlie one another when the binder arrangement 30 is closed.

Each ring board includes a living hinge 122. As will be further shown and described in more detail in FIGS. 7-9, each hinge 122 and 122 is integrally formed of a plurality of pairs of scores 114 (i.e., at least three) that each extend from adjacent a top side edge 116 of the board 108 to a bottom side edge 118 of the board 108.

Figure 2:
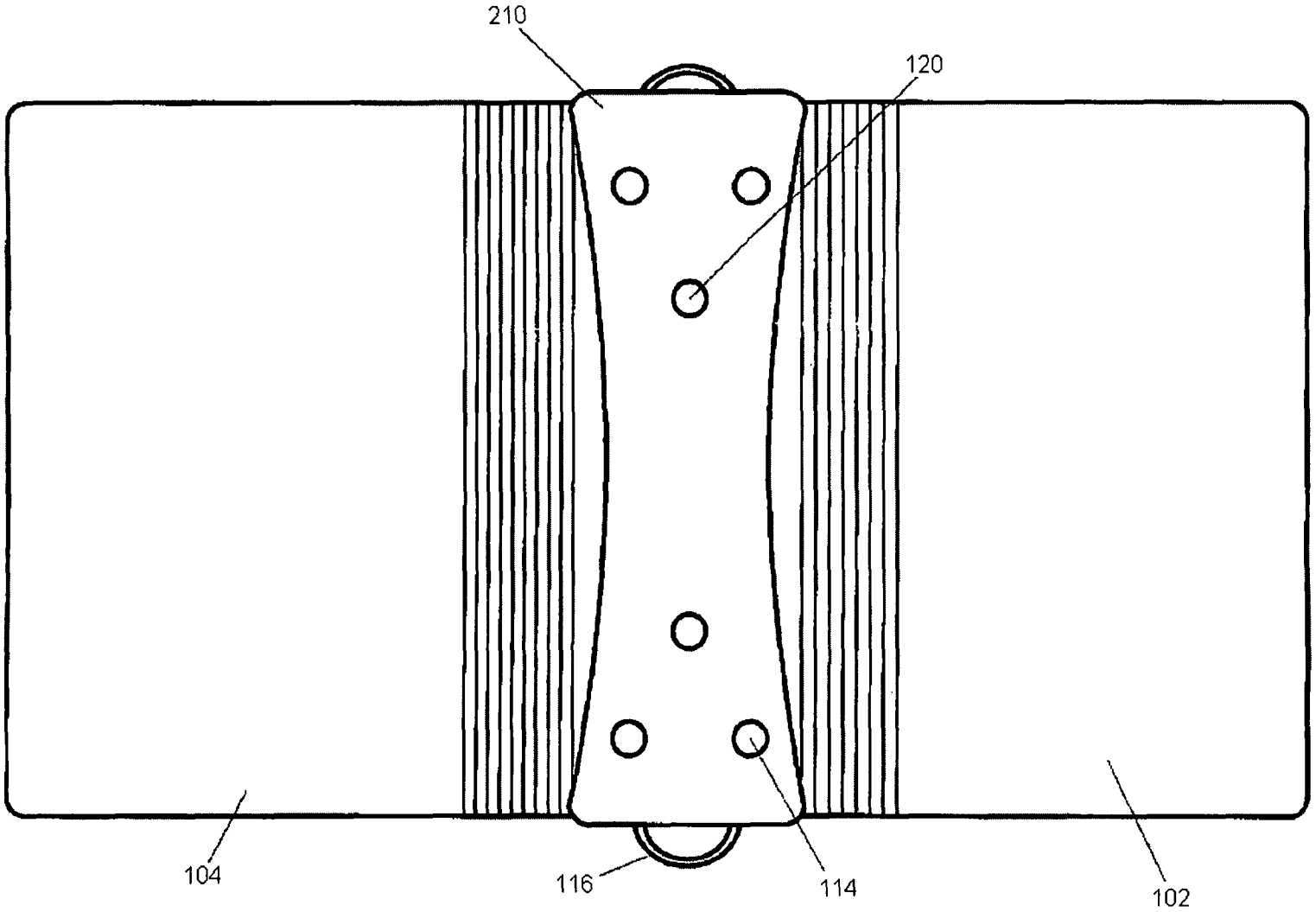
FIG. 2 is an exterior plan view of the binder arrangement of FIG. 1 in a open position.

Turning now to FIG. 2, there is shown an exterior view of the the a front ring board 102 and a rear ring board 104. Additionally, there is depicted and visible in this view, exterior plate 210. Exterior plate 210 is attached to the interior plate 110 using rivets 114 and 120. Rivets 114 and 120 pass through and hold together into a single unit; interior plate 110, front ring board 102, rear ring board 104 and d-ring attachment 112. Exterior plate 210 may also serve as a mounting plate for a handle (not shown) which may be adapted to provide a user with a hand hold for ease of carrying the binder arrangement of the present invention.

Figure 3:
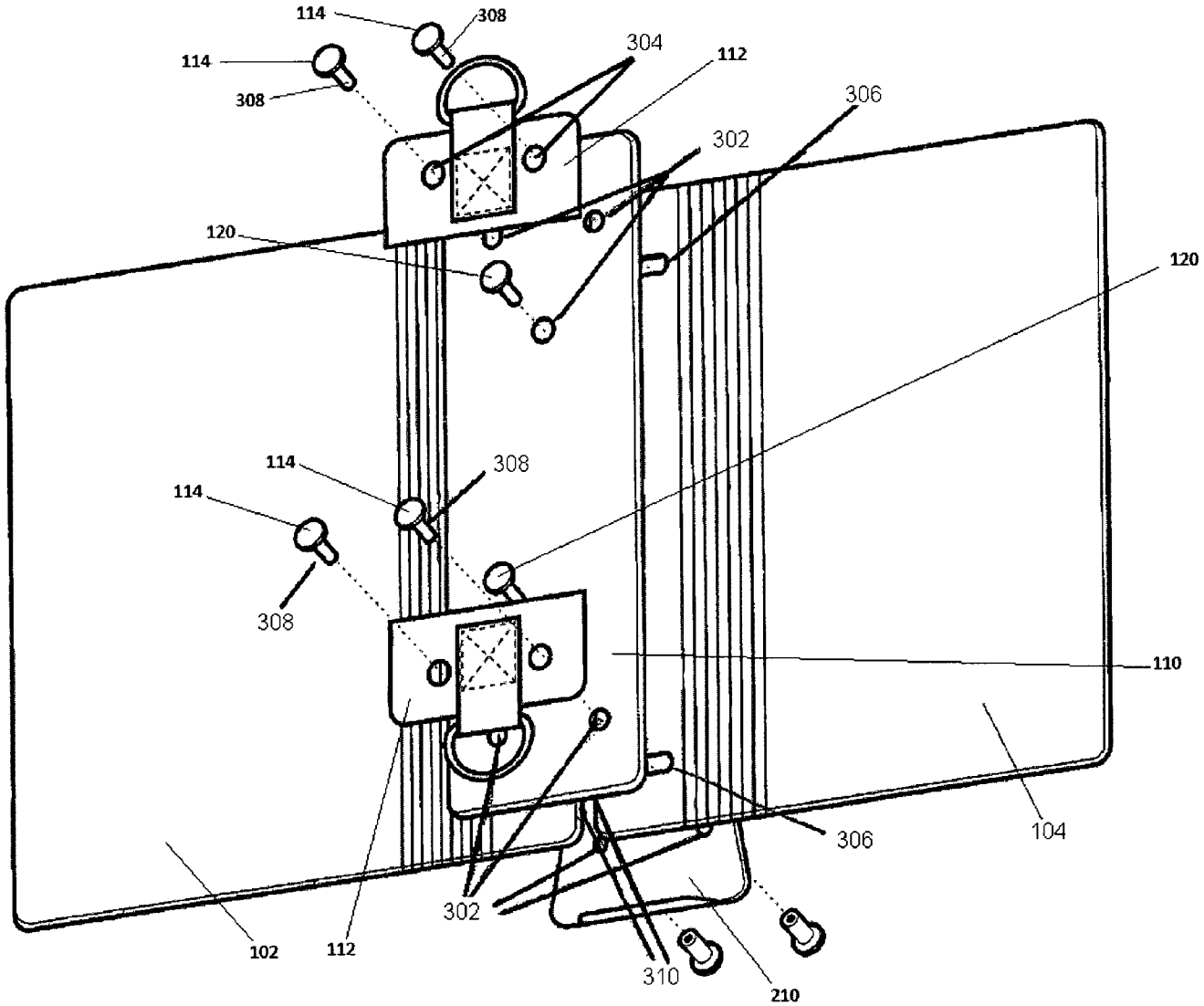
FIG. 3 is an exploded perspective view of the binder arrangement of FIG. 1 in an open position.

Turning to FIG. 3, there is shown an interior exploded view of the binder arrangement according to the present invention. FIG. 3 depicts an interior perspective view of the binder arrangement in an open position constructed according to the present invention that depicts the interior surface and includes a front ring board 102 and a rear ring board 104. Additionally, there is depicted and visible in this view an interior plate 110 and exterior plate 210. Interior plate 110 has mounted thereon a D-ring/zipper attachment 112, which may be, as shown here, a supplemental plate attached to the interior plate 110 using rivets 114. Furthermore in this exploded view, rivet apertures 302 can be seen in interior plate 110 and exterior plate 210. Apertures 302 are circular and adapted to receive a circular shank of rivets 114 and 120, in this way, interior plate 110 and exterior plate 210 are held in a fixed position with respect to each other, thereby forming a spine of binder arrangement 100. Moreover, apertures 302 may be further utilized to affix d-ring/zipper attachment or other such plates or features by aligning attachment apertures 304 with apertures 302 which rivets 114 pass through.

Also visible in this view are elongated oval shaped slots 306 positioned along adjacent inside edges of front ring board 102 and a rear ring board 104 (not visible in this view). Slots 306 are positioned to receive rivets 114 and thereby slidably retain ring boards 102 and 104 between interior plate 110 and exterior plate 210. In this way, the binder arrangement 100 is maintained as a single unit, however, a degree of freedom is provided to both the front ring board and rear ring board. The degree of freedom provided for by the slot 306 allows the ring boards to slide linearly along the rivet shank 308 of rivets 114. Thus the spine of the binder arrangement is adjustable to provide greater or lesser interior volume when the binder is placed into a closed position according to the users needs.

Figure 4:
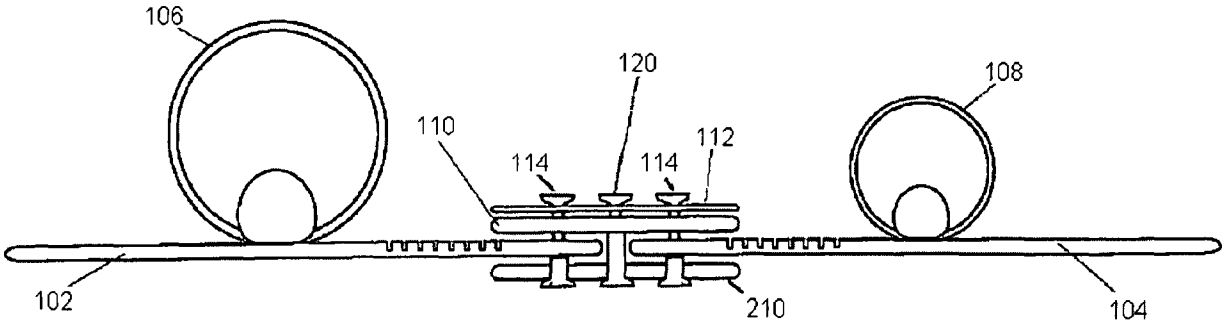
FIG. 4 is a side edge sectional view of the binder arrangement of FIG. 1 in an open position.

Turning now to FIG. 4, there is shown a side edge sectional view of the binder arrangement of FIG. 1 in an open position which depicts the a front ring board 102 and a rear ring board 104, interior plate 110 and exterior plate 210. Interior plate 110 has mounted thereon a D-ring/zipper attachment 112, which may be, as shown here, a supplemental plate attached to the interior plate 110 using rivets 114. Furthermore in this view, rivets 114 and 120 are shown protruding through d-ring/zipper attachment 112, interior plate 110, front 102 and rear 104 ring board respectively and exterior plate 210 to maintain the binder arrangement in a single unit. Apertures 302 (not seen in this view) are adapted to receive a circular shank of rivets 114 and 120 which pass through each of the binder arrangement layers, in this way, interior plate 110 and exterior plate 210 are held in a fixed position with respect to each other, thereby forming a spine of binder arrangement 100.

Figure 5:
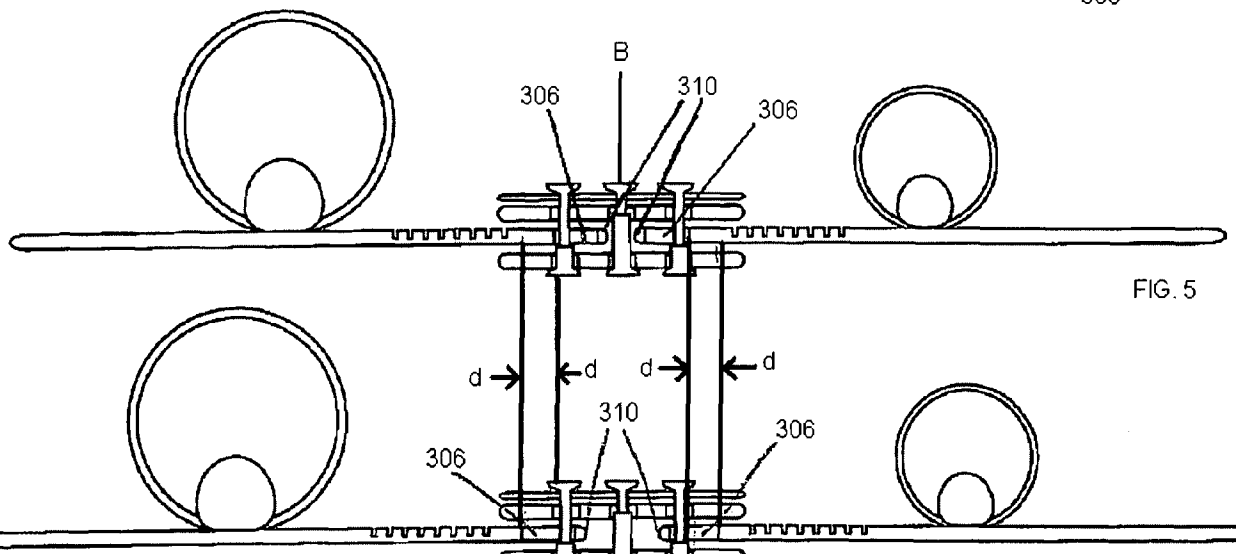
FIG. 5 is a side edge cross sectional view of the binder arrangement along cross-section A-A with binder covers in a contracted position.
Figure 6:
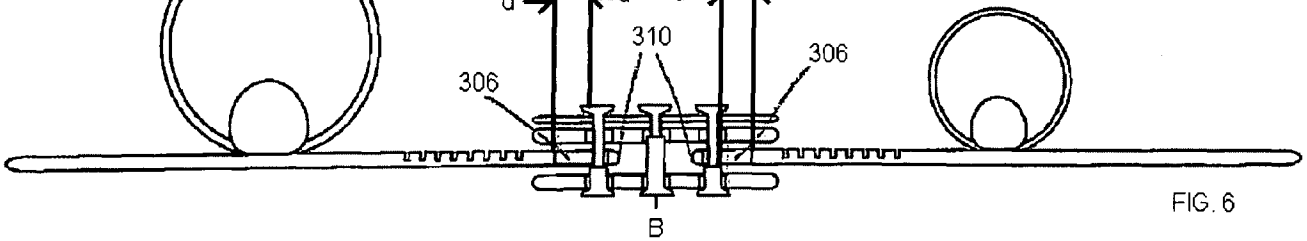
FIG. 6 is a side edge cross sectional view of the binder arrangement along cross-section A-A with binder covers in an expanded position.

Turing now to FIGS. 5 and 6, there is shown a cross sectional view of the binder arrangement along cross-section A-A depicting the translating motion of the front 102 and rear 104 ring boards. As shown in FIG. 5, the inside side edges 310 of both the front and rear ring board are in close proximity to the rivet shank 308 of rivet 120. In this position the slots 306 are positioned such that the open slot aperture is biased to the inside of rivet shank 308, thus providing a degree of freedom to permit movement of the front and rear ring boards away from each other. This movement is depicted in FIG. 6 wherein the inside side edges 310 of both the front and rear ring board are extended away from the rivet shank 308 of rivet 120. In this position the slots 306 are positioned such that the open slot aperture is biased to the outside of rivet shank 308 a distance represented and denoted as d-d, thus providing a degree of freedom to permit movement of the front and rear ring boards towards each other. In this way, the flexible hinge region 122 is moved away from centerline B-B and thus the pivot point of the hinge region can be further from the centerline. By increasing the distance from the centerline to the hinge pivot point, the binder arrangement 100 spine has an increased width and thus the interior volume of the binder arrangement 100 is enlarged when placed into a closed position.

Rivets 114 and 120 may preferably be of sufficient length to retain ring boards 102 and 104 between interior plate 110 and exterior plate 210. Additionally, there may be provided an extended shank of rivets 114 to maintain a gap between interior plate 110 and exterior plate 210 to prevent binding of ring boards 102 and 104 between the interior and exterior plates 110 and 210 and thus allow free translation of the ring boards between the retracted and extended positions. Referring again to FIG. 4, resilient spring or biasing elements 404, may also be included to exert a force to keep the ring boards biased to a retracted position. Thus, when the binder is in a closed position a force is exerted on the inside surface of the ring board by the contents of the binder. If the force exerted by the contents is greater than the spring or biasing 404 element forces, then the ring boards will move to an extended position in response to that force. Otherwise, the biasing force will maintain the ring boards in a retracted position and thus prevent the ring boards from haphazardly moving between a retracted and extended position. While the spring or biasing elements 404 depicted are of a particular design and orientation between interior and exterior plates 110 and 210, it should be understood to one skilled in the art that alternate versions, designs and orientations are contemplated in accordance with the present invention.

Figure 7:
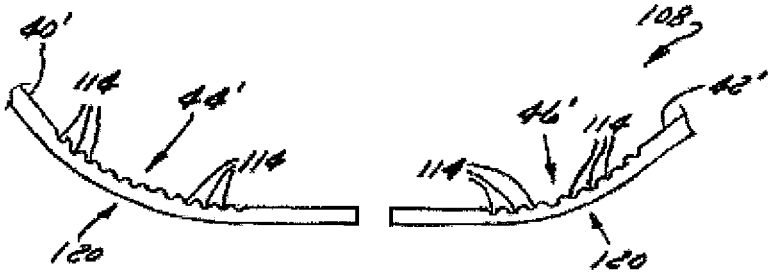
FIG. 7 is an enlarged fragmentary end view of the panel illustrating in more detail each hinge being constructed of a plurality of pairs of scores in an interior surface of the panel.
Figure 8:
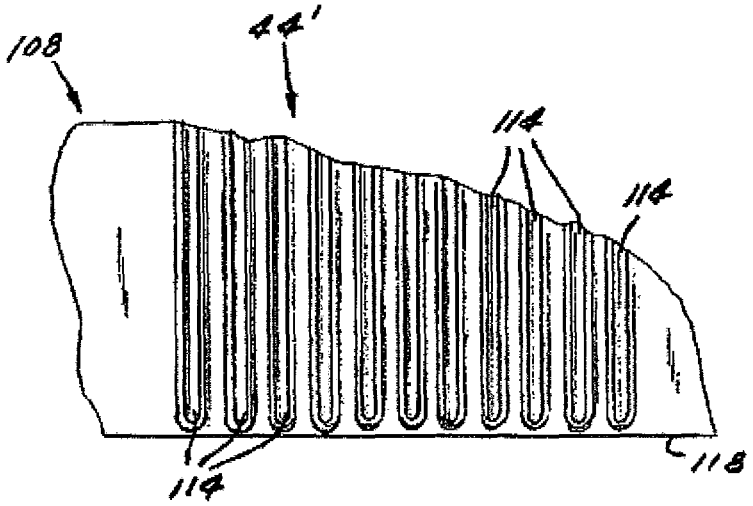
FIG. 8 is an enlarged fragmentary top plan view of another preferred hinge embodiment that is formed by scores that are slits pressed into the surface of the panel.

Turning now to FIGS. 7 and 8, each hinge 122 is integrally formed of a plurality of pairs of scores (for example, at least three, that each extend from adjacent a top side edge of the front and back ring board to a bottom side edge of each ring board respectively. While each score 114 can be a divot, like that shown in FIG. 7, each score 114 preferably is a slit, like that shown in FIG. 8, that extends to a depth that is greater than one-quarter the thickness of the ring boards 102 and 104 and no greater than about one-half the thickness of the ring boards 102 and 104. The scores 114 preferably are equidistantly spaced apart. Preferably, the region of each hinge 44' and 46' is scored such that the scored region compresses the material of the ring boards 102 and 104 at least one-sixty fourth of an inch such that a shape memory is imparted to each hinge that inherently forms a bend 120 in the ring boards 102 and 104 at each hinge. The result is a hinge 44' and 46' that not only permits the front cover 40 and rear cover 42 to bend easily but which also helps form the board 108 into the shape of a binder.

In one preferred embodiment, each hinge 44' and 46' consists of between five and twelve scores 114 and forms a hinge that extends from between one-half inch and one and one-half inches. In a preferred embodiment, each hinge 44' and 46' has at least five scores 114 and an extent of between three quarter of an inch and one and one-quarter inch.

Figure 9:
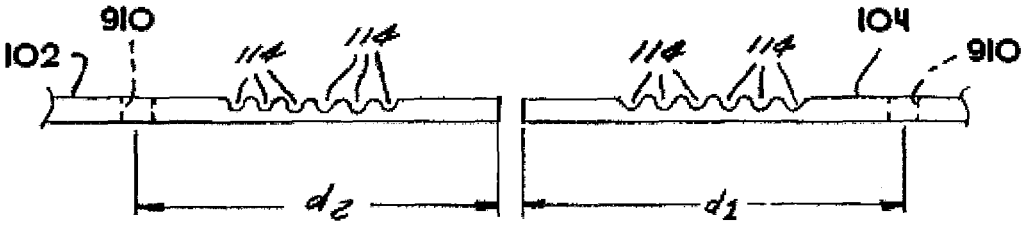
FIG. 9 is an enlarged fragmentary end view of the panel depicting offsetting of binder anchors punched in the panel so as to offset the binder attached to one cover relative to the binder attached to the other cover such that binder ring clashing preferably is prevented.

FIG. 9 illustrates another preferred aspect of the invention where the binder anchors 910 and 112 of each cover are spaced farther away from a side edge 310 than the binder anchors 910 of the other side edge 310 of the other ring board. In the preferred embodiment shown in FIG. 9, the distance, d.sub.1, between anchors 910 and side edge 310 of cover 104 is greater than the distance, d.sub.2, between anchors 910 and side edge 310 of cover 102. In one preferred embodiment, d.sub.1 is between one-quarter inch and three-quarters of an inch greater than d.sub.2 such that one binder 126 is offset relative to the other binder 128 a like amount. In one preferred embodiment, the offset is about one-half inch such that the difference between d.sub.1 and d.sub.2 is about one-half inch. As a result of this offset, where the binder arrangement has a dual opposed binder ring arrangement, the binders 126 and 128 do not directly overlie one another when the binder arrangement is closed. Such an offset advantageously facilitates closing the binder arrangement without the binders 126 and 128 interfering with each other or closure of the binder arrangement.

To help compensate for any loss of binder storage volume that may occur because of the offset, in addition to the adjustable binder spine described herein the binder arrangement preferably is equipped with hinges 44 and 46 of the type depicted in FIGS. 7-9. By equipping the binder arrangement 100 with at least one such hinge and preferably a pair of such hinges, binder storage volume is increased because the relatively wide width of each hinge 122 permits the hinge to change where it bends. As a result, its bending point automatically changes to accommodate whatever the binder storage volume is. As a result, a binder arrangement 100 equipped with a pair of such hinges 122 of the invention can accommodate as much as 40% greater binder storage volume than a binder arrangement equipped with conventional hinges.

In a preferred method of manufacture, a press is used that is equipped with a die that includes a base in which the ring board 102 and 104 is located and held. The die includes an upper half that has ridged scorers that are pressed against the board 102 and 104 to form the scores 114 that define each one of the hinges 122. The upper half of the die preferably also is equipped with punches that form each binder anchor simultaneously with the scores 114.

It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

What is claimed:

1. A binder arrangement comprising:

a) a pair of binder covers including a front binder cover and a rear binder cover pivotable about an axis into an opposed orientation;

b) a front cover binder ring assembly attached to only said front binder cover and a rear cover binder ring assembly attached to only said rear binder cover, c) a pair of hinges for pivoting said pair of covers into an opposed orientation; and d) a spine between said pair of binder covers, a spring for exerting a biasing force on said pair of binder covers for retracting said pair of binder covers wherein said spine is comprised of a portion of each of said pair of covers slidably retained in parallel alignment between an exterior plate and an interior plate;

e) wherein said binder covers have a slot for receiving a pin that is rigidly attached to said spine for slidably attaching said binder covers to said spine.

2. A binder arrangement according to claim 1, further including a rivet that is securely affixed to said pin and wherein said hinder covers slot are adapted to slidably receive said rivet.

3. A binder arrangement according to claim 1 wherein said pair of hinges are pivotable about a variable axis.

4. A binder arrangement having variable interior volume comprising: a. a pair of binder covers including a front binder cover and a rear binder cover pivotable about an axis into an opposed orientation;

b. a front cover binder ring assembly attached to only said front binder cover and a rear binder ring assembly attached to only said rear binder cover, c. a pair of hinges for pivoting said pair of covers into an opposed orientation; wherein said hinges have a variable pivot point, d. an adjustable width spine between said pair of binder covers wherein said-spine is comprised of a portion of each of said pair of covers slidably retained in parallel alignment between an exterior plate and an interior plate; and e. a spring for exerting a biasing force on said pair of binder covers for retracting said pair of binder covers towards said spine.

* * * * *